US010920775B2

(12) United States Patent
Nakai et al.

(10) Patent No.: US 10,920,775 B2
(45) Date of Patent: Feb. 16, 2021

(54) SCROLL COMPRESSOR WITH DIFFERENT SIZED GAPS FORMED BETWEEN INNER AND OUTER PERIPHERAL SURFACES OF SCROLL LAPS

(71) Applicant: DAIKIN INDUSTRIES, LTD., Osaka (JP)

(72) Inventors: Ryouta Nakai, Osaka (JP); Yasuhiro Murakami, Osaka (JP); Yasuo Mizushima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/487,060

(22) PCT Filed: Jun. 7, 2018

(86) PCT No.: PCT/JP2018/021872

§ 371 (c)(1),
(2) Date: Aug. 23, 2019

(87) PCT Pub. No.: WO2018/230437

PCT Pub. Date: Dec. 20, 2018

(65) Prior Publication Data

US 2020/0056610 A1 Feb. 20, 2020

(30) Foreign Application Priority Data

Jun. 14, 2017 (JP) ..... 2017-116657

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/02*** | (2006.01) |

(Continued)

(52) U.S. Cl.
CPC ..... *F04C 18/0215* (2013.01); *F04C 18/0246* (2013.01); *F04C 18/0269* (2013.01);
(Continued)

(58) Field of Classification Search
CPC ..... F04C 18/0215; F04C 18/0246; F04C 18/0269; F04C 18/0276; F04C 23/008;
(Continued)

(56) References Cited

U.S. PATENT DOCUMENTS 6,224,357 B1 5/2001 Komai et al.
6,808,373 B2 * 10/2004 Suefuji ..... F04C 18/0269 418/55.2

(Continued)

FOREIGN PATENT DOCUMENTS

JP 8-21380 A 1/1996
JP 2000-170671 A 6/2000

(Continued)

OTHER PUBLICATIONS

International Search Report of corresponding PCT Application No. PCT/JP2018/021872 dated Sep. 4, 2018.

(Continued)

*Primary Examiner* — Theresa Trieu
(74) *Attorney, Agent, or Firm* — Global IP Counselors, LLP

(57) ABSTRACT

A scroll compressor includes a fixed scroll including a fixed scroll lap, and a movable scroll including a movable scroll lap. A first scroll lap is one of the fixed scroll lap and the movable scroll lap. A second scroll lap is an other of the fixed scroll lap and the movable scroll lap. A second thickness of the second scroll lap is larger than a first thickness of the first scroll lap. A first side face gap is formed between an inner line of the first scroll lap and an outer line of the second scroll lap. A second side face gap is formed between an outer line of the first scroll lap and an inner line of the second scroll lap. The second side face gap is larger than the first side face gap.

18 Claims, 4 Drawing Sheets

(51) Int. Cl.
*F04C 23/00* (2006.01)

(52) U.S. Cl.
CPC ..... *F04C 18/0276* (2013.01); *F04C 23/008* (2013.01); *F04C 2230/602* (2013.01)

(58) Field of Classification Search
CPC ..... F04C 2230/602; F01C 1/0215; F01C 1/0246; F01C 1/0269; F01C 1/0276
USPC ..... 418/55.1–55.6, 57
See application file for complete search history.

(56) References Cited

U.S. PATENT DOCUMENTS

| | | | |
|---|---|---|---|
| 2002/0071780 | A1 | 6/2002 | Chang et al. |
| 2017/0159658 | A1 | 6/2017 | Ohta et al. |

FOREIGN PATENT DOCUMENTS

| | | | | | |
|---|---|---|---|---|---|
| JP | 2002-257060 | A | | 9/2002 | |
| JP | 2015-71947 | A | | 4/2015 | |
| JP | 2017133380 | A | * | 8/2017 | ..... F04C 18/0269 |
| WO | 2015/198516 | A1 | | 12/2015 | |
| WO | WO-2018221416 | A1 | * | 12/2018 | ..... F04C 18/02 |

OTHER PUBLICATIONS

International Preliminary Report of corresponding PCT Application No. PCT/JP2018/021872 dated Dec. 26, 2019.

European Search Report of corresponding EP Application No. 18 81 8449.3 dated Dec. 10, 2019.

* cited by examiner

SCROLL COMPRESSOR WITH DIFFERENT SIZED GAPS FORMED BETWEEN INNER AND OUTER PERIPHERAL SURFACES OF SCROLL LAPS

CROSS-REFERENCE TO RELATED APPLICATIONS

This U.S. National stage application claims priority under 35 U.S.C. § 119(a) to Japanese Patent Application No. 2017-116657, filed in Japan on Jun. 14, 2017, the entire contents of which are hereby incorporated herein by reference.

BACKGROUND

Field of the Invention

The present invention relates to a scroll compressor.

Background Information

In a scroll compressor, a compression chamber is defined by a fixed scroll including a spiral scroll lap and a movable scroll including a spiral scroll lap. Each scroll is in contact with a fluid having different pressures in respective parts, and may thus become deformed due to the differential pressure. In order to prevent the occurrence of a malfunction even if such a defamation occurs, in a scroll compressor disclosed in JP 2015-71947 A, a large gap is set between the inner side of a movable scroll lap and the outer side of a fixed scroll lap. This is predicated on recognition that the movable scroll lap is prone to tilt inward due to its deformation and interfere with the fixed scroll lap located on the inner side thereof.

SUMMARY

A direction in which the scroll lap is prone to tilt varies according to various conditions. Thus, the movable scroll lap tilts outward in some cases. At this time, the configuration proposed by JP 2015-71947 A is prone to being affected by the deformation of the scroll on the contrary, and has a possibility of causing a malfunction such as noise produced by the interference between the fixed scroll lap and the movable scroll lap. When a refrigerant whose temperature can become high is compressed, the scroll lap thermally expands, which increases the possibility of a malfunction.

It is an object of the present invention to provide a scroll compressor that is less likely to cause a malfunction when a scroll becomes deformed due to a differential pressure.

A scroll compressor according to a first aspect of the present invention is provided with a fixed scroll including a fixed scroll lap and a movable scroll including a movable scroll lap. A first scroll lap and a second scroll lap are one and the other of the fixed scroll lap and the movable scroll lap, and a second thickness which is a thickness of the second scroll lap is larger than a first thickness which is a thickness of the first scroll lap. A first side face gap is formed between an inner line of the first scroll lap and an outer line of the second scroll lap. A second side face gap is formed between an outer line of the first scroll lap and an inner line of the second scroll lap. The second side face gap is larger than the first side face gap.

According to this configuration, the second side face gap located on the outer line side of the first scroll lap is larger than the first side face gap located on the inner line side of the first scroll lap. The pressure of the fluid housed on the inner peripheral side of the scroll is higher than the pressure of the fluid housed on the outer peripheral side thereof. Thus, the first scroll lap having a small thickness is prone to tilt outward. Thus, the tilting portion of the first scroll lap is housed in the second side face gap which is relatively large. Accordingly, an interference between the first scroll lap and the second scroll lap is restrained, which makes a malfunction less likely to occur.

A scroll compressor according to a second aspect of the present invention is the scroll compressor according to the first aspect in which the second thickness is equal to or larger than 130% of the first thickness.

According to this configuration, the second thickness is equal to or larger than 130% of the first thickness. The first scroll lap has a higher possibility of tilting than the second scroll lap which is thicker than the first scroll lap by 30% or more. The tilting portion of the first scroll lap can be housed in the second side face gap. Thus, the interference can be more reliably restrained during tilting of the scroll lap.

A scroll compressor according to a third aspect of the present invention is the scroll compressor according to the first aspect or the second aspect in which the second side face gap is equal to or larger than 110% of the first side face gap.

According to this configuration, the second side face gap is equal to or larger than 110% of the first side face gap. Thus, the difference of 10% enables the second side face gap to more reliably house the tilting portion of the first scroll lap.

A scroll compressor according to a fourth aspect of the present invention is the scroll compressor according to the third aspect in which the second side face gap is equal to or larger than 120% of the first side face gap.

According to this configuration, the second side face gap is equal to or larger than 120% of the first side face gap. Thus, the larger difference of 20% enables the second side face gap to further more reliably house the tilting portion of the first scroll lap.

A scroll compressor according to a fifth aspect of the present invention is the scroll compressor according to any one of the first to fourth aspects in which a height of the first scroll lap is equal to or larger than seven times the first thickness.

According to this configuration, the height of the first scroll lap is equal to or larger than seven times the thickness thereof. A scroll lap having a larger ratio of height to thickness is more prone to tilt due to the differential pressure of a fluid. Thus, in the configuration in which the scroll lap is more prone to tilt, the interference between the scroll laps is more reliably restrained.

A scroll compressor according to a sixth aspect of the present invention is the scroll compressor according to any one of the first to fifth aspects in which the second scroll lap includes an inner peripheral side lap part and an outer peripheral side lap part. The first scroll lap includes a reciprocation lap part configured to relatively reciprocate between the inner peripheral side lap part and the outer peripheral side lap part. The first side face gap is a gap formed between the inner peripheral side lap part and the reciprocation lap part. The second side face gap is a gap formed between the outer peripheral side lap part and the reciprocation lap part. The first thickness is a thickness of the reciprocation lap part. The second thickness is a thickness of the outer peripheral side lap part.

According to this configuration, the reciprocation lap part of the first scroll lap is interposed between the inner peripheral side lap part and the outer peripheral side lap part of the second scroll lap. The first side face gap is formed between the reciprocation lap part and the inner peripheral side lap part. The second side face gap is formed between the reciprocation lap part and the outer peripheral side lap part. Thus, in a case where the thickness of the first scroll lap and the thickness of the second scroll lap vary from place to place, it is possible to determine a part of each scroll lap where the first thickness, the second thickness, the first side face gap, and the second side face gap should be obtained.

A scroll compressor according to a seventh aspect of the present invention is the scroll compressor according to any one of the first to sixth aspects in which the first scroll lap is the movable scroll lap. The second scroll lap is the fixed scroll lap.

According to this configuration, since the first scroll lap is the movable scroll lap, the movable scroll has a small thickness, and is thus lightweight. Therefore, only a small rotary driving force for revolving the movable scroll is required, which makes it easy to increase the energy efficiency of the scroll compressor.

The scroll compressor according to the present invention prevents an interference during tilting of a scroll lap, and is less likely to cause a malfunction.

DETAILED DESCRIPTION OF EMBODIMENT(S)

(1) Entire Configuration

Figure 1:
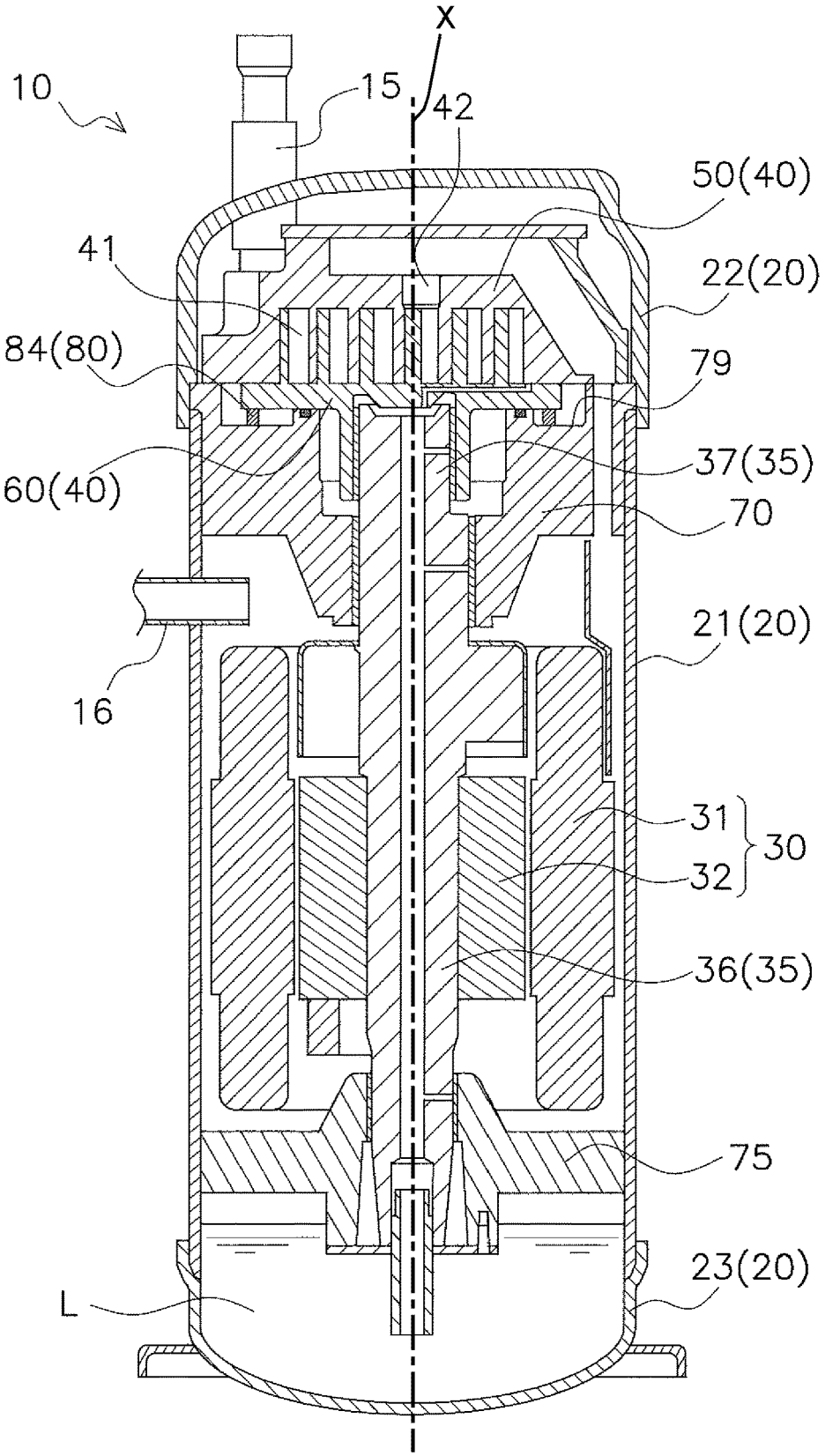
FIG. 1 is a sectional view of a scroll compressor 10 according to an embodiment of the present invention.

FIG. 1 illustrates a scroll compressor 10 according to an embodiment of the present invention. The scroll compressor 10 is mounted on, for example, an air conditioner for compressing a refrigerant which is a fluid. The scroll compressor 10 includes a casing 20, a motor 30, a crank shaft 35, a compression mechanism 40, and frame members 70, 75.

The refrigerant to be compressed by the scroll compressor 10 is, for example, a refrigerant that tends to make the temperature and the pressure of the surroundings of a fixed scroll 50 and a movable scroll 60 of the compression mechanism 40 relatively high. In other words, the refrigerant to be compressed by the scroll compressor 10 is a refrigerant having a relatively high condensation pressure. Specifically, the refrigerant to be compressed by the scroll compressor 10 is, for example, R32 (R32 alone a mixed refrigerant containing 50% or more of R32 (e.g., R410A, R452B, or R454B), or a mixed refrigerant of R1123 and R32. The refrigerant to be compressed by the scroll compressor 10 in the present embodiment is, in particular, a refrigerant having a higher condensation pressure than R410A, such as R32 or a mixed refrigerant of R1123 and R32. However, the refrigerant to be compressed by the scroll compressor 10 is not limited to the refrigerants described above.

(2) Detailed Configuration (2-1) Casing 20

The casing 20 houses various constituent elements of the scroll compressor 10 and the refrigerant therein. The casing 20 is capable of withstanding high pressure of the refrigerant. The casing 20 includes a main body part 21, an upper part 22, and a lower part 23 which are joined to each other. The upper part 22 is provided with a suction pipe 15 for sucking a low-pressure gas refrigerant. The main body part 21 is provided with a discharge pipe 16 for discharging a high-pressure gas refrigerant. A lubricating oil L for lubricating a sliding part in each of the various constituent elements is enclosed in the lower part of the casing 20.

(2-2) Motor 30

The motor 30 is an element for generating power for compressing the refrigerant by receiving electric power supplied thereto. The motor 30 includes a stator 31 and a rotor 32. The stator 31 is fixed to the main body part 21 of the casing 20. The stator 31 includes a coil (not illustrated). The coil receives the electric power to generate an AC magnetic field. The rotor 32 is rotatable disposed inside a cavity on the center of the stator 31. A permanent magnet (not illustrated) is buried in the rotor 32. The rotor 32 rotates to generate power by a force received by the permanent magnet from the AC magnetic field.

(2-3) Crank Shaft 35

The crank shaft 35 is an element for transmitting power generated by the motor 30 to the compression mechanism 40. The crank shaft 35 includes a main shaft part 36 and an eccentric part 37. The main shaft part 36 is fixed penetrating the rotor 32 and concentric with the rotor 32. The eccentric part 37 is eccentric with respect to the rotor 32 and connected to the compression mechanism 40.

(2-4) Compression Mechanism 40

The compression mechanism 40 is an element for compressing a low-pressure gas refrigerant to produce a high-pressure gas refrigerant. The compression mechanism 40 includes the fixed scroll 50 and the movable scroll 60. The fixed scroll 50 is directly or indirectly fixed to the casing 20. The movable scroll 60 is connected to the eccentric part 37 of the crank shaft 35 and revolvable with respect to the fixed scroll 50. The fixed scroll 50 and the movable scroll 60 define compression chambers 41. The revolution of the movable scroll 60 changes the capacity of the compression chambers 41. Accordingly, the low-pressure gas refrigerant is compressed to become the high-pressure gas refrigerant. The high-pressure gas refrigerant is discharged to the outside of the compression mechanism 40 through a discharge port 42.

(2-5) Frame members 70, 75

The frame members 70, 75 rotatably support the crank shaft 35 for rotation about a shaft rotation axis X. One frame member, or the frame member 70 supports the upper side of the main shaft part 36. The other frame member, or the frame member 75 supports the lower side of the main shaft part 36. The frame members 70, 75 are directly or indirectly fixed to the casing 20.

(3) Operation of Scroll Compressor 10

The rotor 32 of the motor 30 illustrated in FIG. 1 rotates by electric power supplied from the outside. The rotation of the rotor 32 is transmitted to the main shaft part 36 of the crank shaft 35. The movable scroll 60 revolves with respect to the fixed scroll 50 by power transmitted from the eccentric part 37 of the crank shaft 35. The low-pressure gas refrigerant taken through the suction pipe 15 enters the compression chamber 41 on the outer peripheral side of the compression mechanism 40. The compression chamber 41 moves to the center of the compression mechanism 40 while reducing the capacity thereof by the revolution of the movable scroll 60. In the process thereof, the low-pressure gas refrigerant is compressed to become the high-pressure gas refrigerant. The high-pressure gas refrigerant is discharged to the outside of the compression mechanism 40 through the discharge port 42, and moves to a casing internal space. Then, the high-pressure gas refrigerant is discharged to the outside of the casing 20 through the discharge pipe 16.

(4) Detailed Configuration of Compression Mechanism 40

Figure 2:
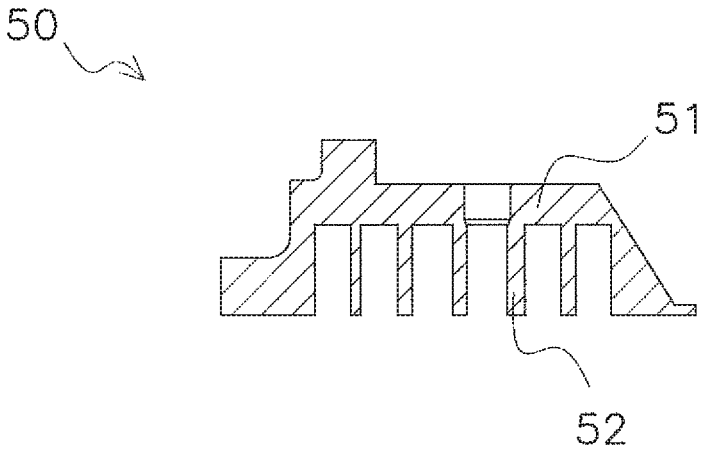
FIG. 2 is a sectional view of a fixed scroll 50 of a compression mechanism 40.

FIG. 2 illustrates the fixed scroll 50. The fixed scroll 50 includes a fixed scroll end plate 51 and a fixed scroll lap 52 which is disposed in a standing manner on the fixed scroll end plate 51. The fixed scroll lap 52 has a spiral shape and, for example, has the shape of an involute curve.

Figure 3:
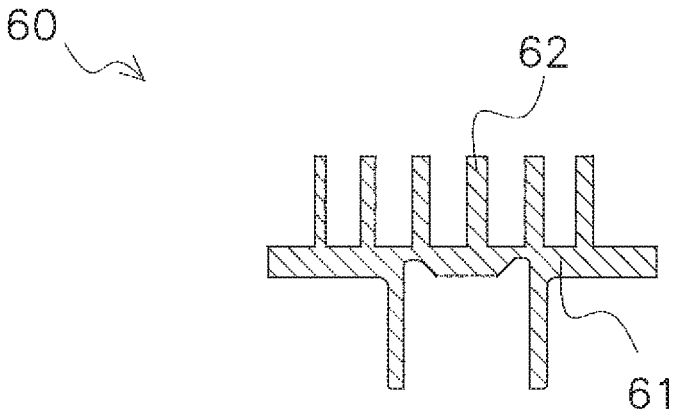
FIG. 3 is a sectional view of a movable scroll 60 of the compression mechanism 40.

FIG. 3 illustrates the movable scroll 60. The movable scroll 60 includes a movable scroll end plate 61 and a movable scroll lap 62 which is disposed in a standing manner on the movable scroll end plate 61. The movable scroll lap 62 has a spiral shape and, for example, has the shape of an involute curve.

Figure 4:
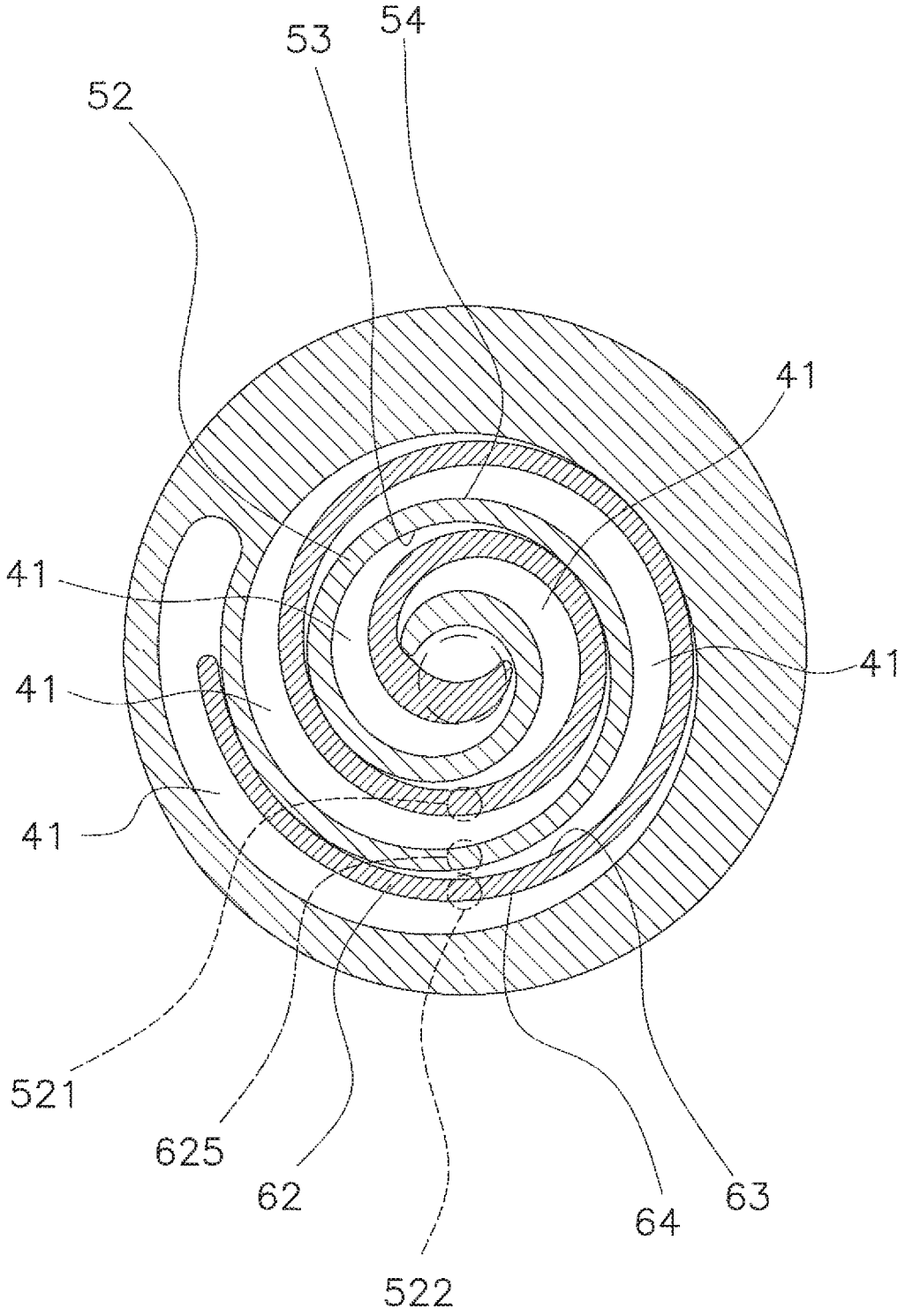
FIG. 4 is a sectional view of the compression mechanism 40 along a horizontal plane.

FIG. 4 is a sectional view of the compression mechanism 40 on a horizontal plane. The fixed scroll lap 52 and the movable scroll lap 62 are close to each other at a plurality of points. There close points are closed with a lubricating oil or the like to form seal points. Accordingly, a plurality of compression chambers 41 separated from each other are defined. The fixed scroll lap 52 includes a fixed scroll lap inner line (fixed scroll lap inner peripheral surface) 53 which is a side on the central side and a fixed scroll lap outer line (fixed scroll lap outer peripheral surface) 54 which is a side on the outer peripheral side. The movable scroll lap 62 includes a movable scroll lap inner line (movable scroll lap inner peripheral surface) 63 which is a side on the central side and a movable scroll lap outer line (movable scroll lap outer peripheral surface) 64 which is a side on the outer peripheral side.

The movable scroll lap 62 is disposed between two adjacent parts of the fixed scroll lap 52. That is, when any part of the movable scroll lap 62 is referred to as a reciprocation lap part 625, the reciprocation lap part 625 is disposed between an inner peripheral side lap part 521 and an outer peripheral side lap part 522 of the fixed scroll lap 52. The reciprocation lap part 625 reciprocates between the inner peripheral side lap part 521 and the outer peripheral side lap part 522 by the revolution of the movable scroll 60.

Figure 5:
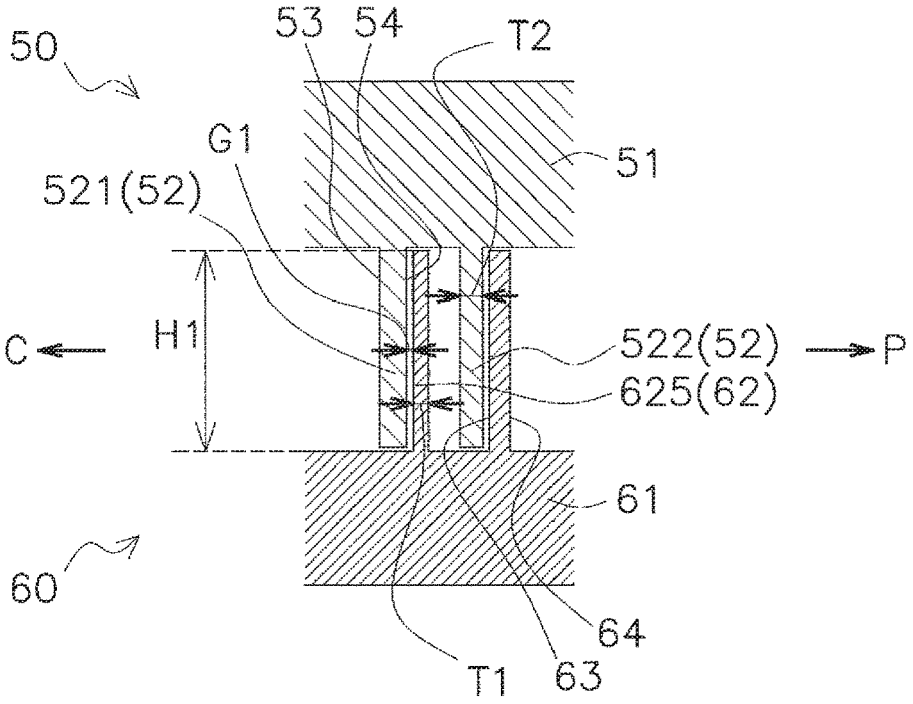
FIG. 5 is a schematic diagram illustrating a cross section of the compression mechanism 40.
Figure 6:
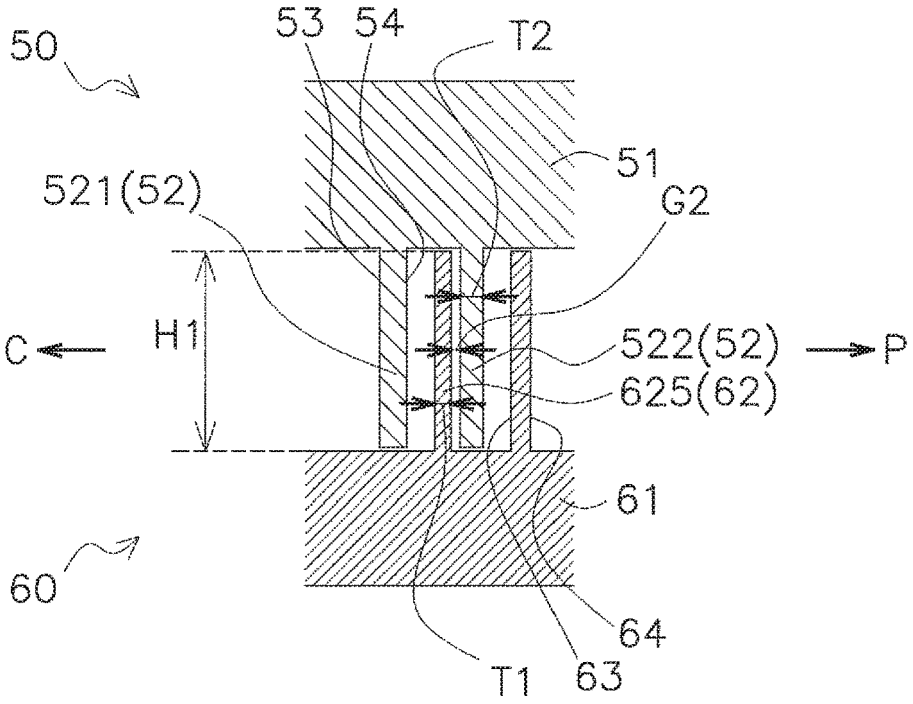
FIG. 6 is a schematic diagram illustrating the cross section of the compression mechanism 40.

FIGS. 5 and 6 illustrate the inner peripheral side lap part 521 and the outer peripheral side lap part 522 of the fixed scroll lap 52 and the reciprocation lap part 625 of the movable scroll lap 62. The inner peripheral side lap part 521 is located on the central side C of the compression mechanism 40. The outer peripheral side lap part 522 is located on the outer peripheral side P of the compression mechanism 40. The reciprocation lap part 625 is located between the inner peripheral side lap part 521 and the outer peripheral side lap part 522. The thickness of the reciprocation lap part 625 is referred to as a first thickness T1, and the thickness of the outer peripheral side lap part 522 is referred to as a second thickness T2. Further, the height of the movable scroll lap 62 is referred to as a first height H1.

FIG. 5 illustrates a state in which the reciprocation lap part 625 is closest to the inner peripheral side lap part 521. A gap formed between the inner peripheral side lap part 521 and the reciprocation lap part 625 at this time is referred to as a first side face gap G1. The first side face gap G1 is formed between the movable scroll lap inner line 63 and the fixed scroll lap outer line 54.

FIG. 6 illustrates a state in which the reciprocation lap part 625 is closest to the outer peripheral side lap part 522. A gap formed between the outer peripheral side lap part 522 and the reciprocation lap part 625 at this time is referred to as a second side face gap G2. The second side face gap G2 is formed between the movable scroll lap outer line 64 and the fixed scroll lap inner line 53.

In the compression mechanism 40 of the scroll compressor 10 according to the present embodiment, dimensions are set as described below.

The second side face gap G2 is set larger than the first side face gap G1. Specifically, the second side face gap G2 is equal to or larger than 110% of the first side face gap G1, and preferably equal to or larger than 120% of the first side face gap G1. Further, for example, the second side face gap G2 may be set equal to or smaller than 1000% of the first side face gap G1, and preferably equal to or smaller than 500% of the first side face gap G1.

The second thickness T2 is set equal to or larger than 130% of the first thickness T1. Further, for example, the second thickness T2 may be set equal to or smaller than 1000% of the first thickness T1, and preferably equal to or smaller than 500% of the first thickness T1.

The first height H1 is set equal to or larger than seven times the first thickness T1. Further, for example, the first height H1 may be set equal to or smaller than 100 times the first thickness T1, and preferably equal to or smaller than 50 times the first thickness T1

(5) Characteristics (5-1)

The second side face gap G2 located on the movable scroll lap outer line 64 side is larger than the first side face gap G1 located on the movable scroll lap inner line 63 side. The pressure of the refrigerant housed on the central side C of the compression mechanism 40 is higher than the pressure of the refrigerant housed on the outer peripheral side P thereof. Thus, the reciprocation lap part 625 of the movable scroll lap 62 is prone to tilt outward, the reciprocation lap part 625 having the first thickness T1 which is a small thickness. Thus, the tilting portion of the reciprocation lap part 625 is housed in the second side face gap G2 which is relatively large. Accordingly, an interference between the movable scroll lap 62 and the fixed scroll lap 52 is restrained, which makes a malfunction less likely to occur.

(5-2)

The second thickness T2 is equal to or larger than 130% of the first thickness T1. The movable scroll lap 62 has a higher possibility of tilting than the fixed scroll lap 52 which is thicker than the movable scroll lap 62 by 30% or more. The tilting portion of the movable scroll lap 62 can be housed in the second side face gap G2. Thus, the interference can be more reliably restrained during tilting of the movable scroll lap 62.

(5-3)

The second side face gap G2 is equal to or larger than 110% of the first side face gap G1, and preferably equal to or larger than 120% of the first side face gap G1. Thus, the difference of 10% or 20% enables the second side face gap to more reliably house the tilting portion of the movable scroll lap 62.

(5-4)

Time first height H1, which is the height of the movable scroll lap 62, is equal to or larger than seven times the first thickness T1 which is the thickness of the movable scroll lap 62. A scroll lap having a larger ratio of height to thickness is more prone to tilt due to the differential pressure of a fluid. Thus, in the configuration in which the movable scroll lap 62 is more prone to tilt, the interference between the movable scroll lap 62 and the fixed scroll lap 52 is more reliably restrained.

(5-5)

The reciprocation lap part 625 of the movable scroll lap 62 is interposed between the inner peripheral side lap part 521 and the outer peripheral side lap part 522 of the fixed scroll lap 52. The first side face gap G1 is formed between the reciprocation lap part 625 and the inner peripheral side lap part 521. The second side face gap G2 is formed between the reciprocation lap part 625 and the outer peripheral side lap part 522. Thus, in a case where the thickness of the movable scroll lap 62 and the thickness of the fixed scroll lap 52 vary from place to place, it is possible to determine a part of each scroll lap where the first thickness T1, the second thickness T2, the first side face gap G1, and the second side face gap G2 should be obtained.

(5-6)

The movable scroll 60, which is a movable component, includes the movable scroll lap 62 having the first thickness T1 which is a small thickness. Thus, the movable scroll 60 is lightweight. Therefore, only a small rotary driving force for revolving the movable scroll 60 is required, which makes it easy to increase the energy efficiency of the scroll compressor 10.

(6) Modifications

Hereinbelow, modifications of the present embodiment will be described plurality of modifications may be appropriately combined.

(6-1) Modification A

In the above embodiment, the first thickness T1 is the thickness of the reciprocation lap part 625, and the second thickness T2 is the thickness of the outer peripheral side lap part 522. Alternatively, the first thickness T1 may be the thickness of the reciprocation lap part 625, and the second thickness T2 may be the thickness of the inner peripheral side lap part 521 instead of the outer peripheral side lap part 522. Under such a condition, for example, the ratio between the first thickness T1 and the second thickness T2 already described above may be applied.

This configuration can change a constraint on design while obtaining the effect of restraining the interference between the movable scroll lap 62 and the fixed scroll lap 52.

(6-2) Modification B

For example, the fixed scroll 50 and the movable scroll 60 may be interchanged for the conditions of the various dimensions described in the above embodiment. Specifically, for example, the reciprocation lap part 625, the first thickness T1, and the first height H1 may relate to the fixed scroll 50, and the inner peripheral side lap part 521, the outer peripheral side lap part 522, and the second thickness T2 may relate to the movable scroll 60. Under such a condition, for example, the large-small relationship between the first side face gap G1 and the second side face gap (32, the ratio between the first thickness T1 and the second thickness T2, and the other conditions of the various dimensions may be applied.

According to this configuration, since the fixed scroll lap 52 has the first thickness T1 which is a small thickness, the fixed scroll lap 52 is more prone to tilt. Under such a condition, it is possible to obtain the effect of restraining the interference between the movable scroll lap 62 and the fixed scroll lap 52.

What is claimed is:

1. A scroll compressor comprising:

a fixed scroll including a fixed scroll lap; and a movable scroll including a movable scroll lap, the fixed and movable laps of the fixed and movable scrolls meshing with each other to form a compression chamber therebetween, and the movable scroll revolving in order to compress a fluid in the compressions chamber, a first scroll lap being one of the fixed scroll lap and the movable scroll lap, a second scroll lap being an other of the fixed scroll lap and the movable scroll lap, and a second thickness of the second scroll lap being larger than a first thickness of the first scroll lap, the second scroll lap including an inner peripheral side lap part and an outer peripheral side lap part, the first scroll lap including a reciprocation lap part arranged to relatively reciprocate between the inner peripheral side lap part and the outer peripheral side lap part, a first side face gap being formed between an inner peripheral surface of the first scroll lap and an outer peripheral surface of the second scroll lap in a state in which the reciprocation lap part of the first scroll lap is closest to the inner peripheral side lap part of the second scroll lap, the first side face gap being measured at a location where the reciprocation lap part of the first scroll lap is closest to the inner peripheral side lap part of the second scroll lap, a second side face gap being formed between an outer peripheral surface of the first scroll lap and an inner peripheral surface of the second scroll lap in a state in which the reciprocation lap part of the first scroll lap is closest to the outer peripheral side lap part of the second scroll lap, the second side face gap being measured at a location where the reciprocation lap part of the first scroll lap is closest to the outer peripheral side lap part of the second scroll lap, the outer peripheral surface of the first scroll lap being disposed radially outward of the inner peripheral surface of the first scroll lap relative to a shaft rotation axis, and the outer peripheral surface of the second scroll lap being disposed radially outward of the inner peripheral surface of the second scroll lap relative to the shaft rotation axis, and the second side face gap being larger than the first side face gap.

2. The scroll compressor according to claim 1, wherein the second thickness is equal to or larger than 130% of the first thickness.

3. The scroll compressor according to claim 2, wherein the second side face gap is equal to or larger than 110% of the first side face gap.

4. The scroll compressor according to claim 3, wherein the second side face gap is equal to or larger than 120% of the first side face gap.

5. The scroll compressor according to claim 2, wherein a height of the first scroll lap is equal to or larger than seven times the first thickness.

6. The scroll compressor according to claim 2, wherein the first thickness is a thickness of the reciprocation lap part, and the second thickness is a thickness of the outer peripheral side lap part.

7. The scroll compressor according to claim 2, wherein the first scroll lap is the movable scroll lap, and the second scroll lap is the fixed scroll lap.

8. The scroll compressor according to claim 1, wherein the second side face gap is equal to or larger than 110% of the first side face gap.

9. The scroll compressor according to claim 8, wherein the second side face gap is equal to or larger than 120% of the first side face gap.

10. The scroll compressor according to claim 8, wherein a height of the first scroll lap is equal to or larger than seven times the first thickness.

11. The scroll compressor according to claim 8, wherein the first thickness is a thickness of the reciprocation lap part, and the second thickness is a thickness of the outer peripheral side lap part.

12. The scroll compressor according to claim 8, wherein the first scroll lap is the movable scroll lap, and the second scroll lap is the fixed scroll lap.

13. The scroll compressor according to claim 1, wherein a height of the first scroll lap is equal to or larger than seven times the first thickness.

14. The scroll compressor according to claim 13, wherein the first thickness is a thickness of the reciprocation lap part, and the second thickness is a thickness of the outer peripheral side lap part.

15. The scroll compressor according to claim 13, wherein the first scroll lap is the movable scroll lap, and the second scroll lap is the fixed scroll lap.

16. The scroll compressor according to claim 1, wherein the first thickness is a thickness of the reciprocation lap part, and the second thickness is a thickness of the outer peripheral side lap part.

17. The scroll compressor according to claim 16, wherein the first scroll lap is the movable scroll lap, and the second scroll lap is the fixed scroll lap.

18. The scroll compressor according to claim 1, wherein the first scroll lap is the movable scroll lap, and the second scroll lap is the fixed scroll lap.

* * * * *